US011428224B2

(12) United States Patent
Park et al.

(10) Patent No.: US 11,428,224 B2
(45) Date of Patent: Aug. 30, 2022

(54) VANE ROTARY COMPRESSOR HAVING A BEARING WITH BACK PRESSURE POCKETS

(71) Applicant: LG ELECTRONICS INC., Seoul (KR)

(72) Inventors: Joonhong Park, Seoul (KR); Seoungmin Kang, Seoul (KR); Seheon Choi, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 281 days.

(21) Appl. No.: 16/528,716

(22) Filed: Aug. 1, 2019

(65) Prior Publication Data

US 2020/0149531 A1 May 14, 2020

(30) Foreign Application Priority Data

Nov. 9, 2018 (KR) ..... 10-2018-0137651

(51) Int. Cl.
*F04C 18/344* (2006.01)
*F04C 29/02* (2006.01)
*F01C 21/08* (2006.01)

(52) U.S. Cl.
CPC ..... *F04C 18/344* (2013.01); *F01C 21/0872* (2013.01); *F04C 29/025* (2013.01); *F04C 29/028* (2013.01); *F04C 2240/56* (2013.01)

(58) Field of Classification Search
CPC ..... F01C 21/0872; F04C 18/344; F04C 2240/56; F04C 29/025; F04C 29/028
See application file for complete search history.

(56) References Cited

U.S. PATENT DOCUMENTS 2,588,342 A * 3/1952 Bidwell ..... F04C 18/344 418/82
3,760,478 A * 9/1973 Harlin ..... F04C 29/025 29/888.025

(Continued)

FOREIGN PATENT DOCUMENTS

CN 105402125 B 6/2018
EP 2851568 A1 3/2015

(Continued)

OTHER PUBLICATIONS

Extended European Search Report issued by the European Patent Office in corresponding EP Application No. 19193995.8, dated Mar. 6, 2020 (5 pages).

*Primary Examiner* — Mary Davis
(74) *Attorney, Agent, or Firm* — Birch, Stewart, Kolasch & Birch, LLP

(57) ABSTRACT

A vane rotary compressor has a cylinder. A main bearing and a sub bearing are coupled to the cylinder forming a compression space. The main and sub bearing each have a back pressure pocket on a surface facing the cylinder. The main bearing and the sub bearing radially support a rotation shaft. A roller coupled to the shaft is disposed within the compression space. The roller has circumferentially spaced vane slots, each vane slot extending from an open end on an outer circumferential surface of the roller to a back pressure chamber disposed within the roller at an opposite end of each vane slot. A plurality of vanes slide within the vane slots and divide the compression space into compression chambers. At least one of the back pressure chambers in the vane slots fluidly communicates with at least one of the back pressure pockets in the main and sub bearings.

21 Claims, 10 Drawing Sheets

(56) References Cited

U.S. PATENT DOCUMENTS

| | | | | |
|---|---|---|---|---|
| 3,981,703 | A * | 9/1976 | Glanvall | F04B 27/0606 62/509 |
| 4,571,164 | A | 2/1986 | Shibuya et al. | |
| 11,174,863 | B2 * | 11/2021 | Park | F01C 21/0845 |
| 2003/0063991 | A1 * | 4/2003 | Toyama | F01C 21/0872 418/93 |
| 2015/0267703 | A1 | 9/2015 | Yanagawa et al. | |
| 2016/0333877 | A1 * | 11/2016 | Tsuda | F04C 18/344 |
| 2020/0158111 | A1 * | 5/2020 | Park | F04C 18/344 |
| 2020/0224656 | A1 * | 7/2020 | Moon | F01C 21/0872 |
| 2020/0277956 | A1 * | 9/2020 | Noh | F04C 29/028 |

FOREIGN PATENT DOCUMENTS

| | | | |
|---|---|---|---|
| JP | 2013213438 | A | 10/2013 |
| KR | 10-2018-0095391 | A | 8/2018 |
| WO | WO 2007/029481 | A1 | 3/2007 |
| WO | WO 2014/156609 | A1 | 10/2014 |

* cited by examiner

VANE ROTARY COMPRESSOR HAVING A BEARING WITH BACK PRESSURE POCKETS

CROSS-REFERENCE TO RELATED APPLICATION

Pursuant to 35 U.S.C. § 119(a), this application claims the benefit of earlier filing date and right of priority to Korean Application No. 10-2018-0137651, filed on Nov. 9, 2018, the contents of which are incorporated by reference herein in their entirety.

BACKGROUND OF THE DISCLOSURE

1. Field of the Disclosure

The present disclosure relates to a compressor, more particularly, a vane rotary compressor in which a vane protruding from a rotating roller comes in contact with an inner circumferential surface of a cylinder to form a compression chamber.

2. Background Art

A rotary compressor can be divided into two types, namely, a type in which a vane is slidably inserted into a cylinder to come in contact with a roller, and another type in which a vane is slidably inserted into a roller to come in contact with a cylinder. Normally, the former is referred to as a 'rotary compressor' and the latter is referred to as a 'vane rotary compressor'.

As for a rotary compressor, a vane inserted in a cylinder is pulled out toward a roller by elastic force or back pressure to come into contact with an outer circumferential surface of the roller. On the other hand, for a vane rotary compressor, a vane inserted in a roller rotates together with the roller, and is pulled out by centrifugal force applied to the vane and back pressure formed in the back pressure chamber to come into contact with an inner circumferential surface of a cylinder.

A rotary compressor independently forms compression chambers as many as the number of vanes per revolution of a roller, and each compression chamber simultaneously performs suction, compression, and discharge strokes. On the other hand, a vane rotary compressor continuously forms compression chambers as many as the number of vanes per revolution of a roller, and each compression chamber sequentially performs suction, compression, and discharge strokes. Accordingly, the vane rotary compressor has a higher compression ratio than the rotary compressor. Therefore, the vane rotary compressor is more suitable for high pressure refrigerants such as R32, R410a, and CO2, which have low ozone depletion potential (ODP) and global warming index (GWP).

Such a vane rotary compressor is disclosed in Patent Document [Japanese Patent Application Laid-Open No. JP2013-213438A, (Published on Oct. 17, 2013)]. The related art vane rotary compressor discloses a low-pressure type in which a suction refrigerant is filled in an inner space of a motor chamber but has a structure in which a plurality of vanes is slidably inserted into a rotating roller, which is a feature of a vane rotary compressor.

As disclosed in the patent document, back pressure chambers R are formed at rear end portions of vanes, respectively, communicating with back pressure pockets 21, 31 and 22, 32. The back pressure pockets are divided into a first pocket

21, 31 at a first intermediate pressure and a second pocket 22, 32 at a second intermediate pressure higher than the first intermediate pressure and close to a discharge pressure. Oil is depressurized between a rotation shaft and a bearing and introduced into the first pocket through a gap between the rotation shaft and the bearing. On the other hand, oil is introduced into the second pocket, with almost no pressure loss, through a flow path 34*a* penetrating through the bearing due to the gap between the rotation shaft and the bearing blocked. Therefore, the first pocket communicates with a back pressure chamber located at an upstream side, and the second pocket communicates with a back pressure chamber located at a downstream side based on a direction toward a discharge part from a suction part.

However, in the related art vane rotary compressor, a second pocket, among back pressure chambers, has a surface closed toward a rotation shaft to form a bearing surface. On the other hand, a first pocket has an inner circumferential surface opened toward the rotation shaft to form a sort of a discontinued surface, thus a bearing surface is not formed. This lowers overall support force of a bearing since surface pressure is greatly generated due to characteristics of a vane rotary compressor. As a result, behavior of the rotation shaft becomes unstable and abrasion or frictional loss between the rotation shaft and the bearing is increased, thereby decreasing mechanical efficiency.

Further, pressure of the first pocket, opened between the bearing and the rotation shaft, is not constant, which leads to increased fluctuations in back pressure for supporting the vane. Accordingly, behavior of the vane becomes unstable, and collision noise between the vane and the cylinder or leakage between compression chambers is increased.

Furthermore, there is a possibility of abrasion on the bearing surface caused by foreign materials accumulated in the first pocket opened between the bearing and the rotation shaft during long-time operation.

This may be particularly problematic for the related art vane rotary compressor when a high-pressure refrigerant such as R32, R410a, and CO2 is used. In more detail, when the high-pressure refrigerant is used, the same level of cooling capability may be obtained as that when using relatively a low-pressure refrigerant such as R134a, even though the volume of each compression chamber is reduced by increasing the number of vanes. However, if the number of vanes increases, a frictional area between the vanes and the cylinder are increased accordingly. As a result, a bearing surface on the rotation shaft is reduced, which makes behavior of the rotation shaft more unstable, leading to a further increase in mechanical friction loss. This may be even worse under a low-temperature heating condition, a high pressure ratio condition ($Pd/Ps \geq 6$), and a high-speed operating condition (above 80 Hz).

SUMMARY OF THE DISCLOSURE

One aspect of the present disclosure is to provide a vane rotary compressor capable of enhancing mechanical efficiency between a rotation shaft and a bearing by increasing a radial supporting force to the rotation shaft while differentiating back pressure applied to a vane according to a vane position.

Another aspect of the present disclosure is to provide a vane rotary compressor capable of stabilizing behavior of a rotation shaft by forming a bearing surface for supporting the rotation shaft as a continuous surface or by minimizing a discontinuous surface of the bearing surface.

Still another aspect of the present disclosure is to provide a vane rotary compressor capable of enhancing compression efficiency, stabilizing behavior of a vane by lowering pressure pulsation of back pressure for supporting the vane so as to lower collision noise between the vane and a cylinder and reducing leakage between compression chambers.

Still another aspect of the present disclosure is to provide a vane rotary compressor capable of preventing abrasion on a bearing or a rotation shaft by blocking foreign materials from accumulating between the bearing and the rotation shaft even during long-time operation.

Still another aspect of the present disclosure is to provide a vane rotary compressor capable of enhancing radial supporting force to a rotation shaft when a high-pressure refrigerant such as R32, R410a, and CO2 is used.

Still another aspect of the present disclosure is to provide a vane rotary compressor capable of enhancing radial supporting force to a rotation shaft even under a low-temperature heating condition, a high pressure ratio condition, and a high-speed operation condition.

In order to achieve the aspects of the present disclosure, there is provided a vane rotary compressor, including a cylinder, a main bearing and a sub bearing each coupled to the cylinder to form a compression space together with the cylinder and having a back pressure pocket formed on a surface facing the cylinder, a rotation shaft radially supported by the main bearing and the sub bearing, a roller provided with a plurality of vane slots formed along a circumferential direction and having one end opened toward an outer circumferential surface, and back pressure chambers each formed in another end of the vane slots so as to communicate with the back pressure pocket, and a plurality of vanes slidably inserted into the vane slots of the roller and protruding in a direction toward an inner circumferential surface of the cylinder when the roller rotates so as to divide the compression space into a plurality of compression chambers, wherein the back pressure pocket is divided into a plurality of pockets having different inner pressure along the circumferential direction, and wherein the plurality of pockets is provided with bearing protrusion portions formed on an inner circumferential side facing an outer circumferential surface of the rotation shaft and forming radial bearing surfaces with respect to the outer circumferential surface of the rotation shaft.

Here, the plurality of pockets may be provided with a first pocket having first pressure and a second pocket having second pressure higher than the first pressure. The bearing protrusion portion of the second pocket may be provided with a communication flow path through which an inner circumferential surface of the bearing protrusion portion facing the outer circumferential surface of the rotation shaft communicates with an outer circumferential surface as an opposite side surface of the inner circumferential surface of the bearing protrusion portion.

In addition, the communication flow path may be formed in a manner that at least part thereof overlaps an oil groove provided on a radial bearing surface of the main bearing or the sub bearing.

The communication flow path may be formed as a communication groove recessed by a predetermined width and depth into an axial end surface of the bearing protrusion portion.

The communication flow path may be alternatively formed as a communication hole penetrating through an inner circumferential surface and an outer circumferential surface of the bearing protrusion portion.

In addition, the communication flow path may be formed so that an area thereof at an inner circumferential surface of the bearing protrusion portion is larger than an area at an outlet side thereof.

Here, if an axial depth of the back pressure pocket is H and a radial width of the bearing protrusion portion is T, $2 \leq H/T \leq 6$ may be satisfied.

Also, if a portion of the main bearing or the sub bearing defining a compression space is a flange portion and a thickness of the flange portion is L, $H-L \geq 2$ may be satisfied.

In addition, the bearing protrusion portion may be formed to have the same axial depth and radial width along a circumferential direction.

Here, the roller may be concentric with a center of the rotation shaft and eccentric with respect to a center of the cylinder so as to rotate together with the rotation shaft.

The outer circumferential surface of the roller may be disposed to be close to an inner circumferential surface of the cylinder at one point.

Here, the rotation shaft may be provided with an oil flow path formed in a central portion thereof along an axial direction. The oil flow path may be provided with an oil passage hole formed through an inner circumferential surface thereof toward the outer circumferential surface of the rotation shaft. The oil passage hole may be formed within a range of the radial bearing surface.

The oil passage hole may be formed in a manner that at least part thereof overlaps an axial range of the bearing protrusion portion.

In order to achieve the aspects of the present disclosure, there is provided a vane rotary compressor, including a casing having a sealed inner space, a driving motor installed in the inner space of the casing and generating rotational force, a cylinder provided at one side of the driving motor in the inner space of the casing, a main bearing and a sub bearing coupled to the cylinder to form a compression space together with the cylinder, a rotation shaft having one end coupled to the driving motor and another end penetrating through the main bearing and the sub bearing so as to be radially supported, and provided with an oil flow path formed axially through a central part thereof, a roller concentric with a center of the rotation shaft, provided with a plurality of vane slots each formed along a circumferential direction and having one end opened toward an outer circumferential surface, and back pressure chambers each formed in another end of the vane slot in a communicating manner, and a plurality of vanes slidably inserted into the vane slots of the roller, and configured to protrude in a direction toward an inner circumferential surface of the cylinder when the roller rotates so as to divide the compression space into a plurality of compression chambers, wherein the back pressure chambers communicate with a plurality of back pressure pockets having different inner back pressure in an independent manner, wherein a back pressure pocket, among the plurality of back pressure pockets, having a relatively high inner pressure is provided with a communication flow path so as to communicate with the oil flow path of the rotation shaft, and wherein the communication flow path is formed to be smaller than a cross-sectional area of an inner circumferential side of the back pressure pocket facing the rotation shaft.

Here, the back pressure pockets are provided with bearing protrusion portions formed on an inner circumferential side facing the outer circumferential surface of the rotation shaft and forming radial bearing surfaces with respect to the outer circumferential surface of the rotation shaft, and the communication flow path may be formed on the bearing protrusion portions.

In a vane rotary compressor according to the present disclosure, as a bearing protrusion portion is formed on an inner circumferential side of a back pressure pocket facing a rotation shaft, a bearing surface of a shaft receiving portion that radially supports the rotation shaft can form a continuous surface. Further, an elastic bearing effect can be enhanced as the bearing protrusion portion forms a continuous surface. Accordingly, behavior of the rotation shaft can become stable so that mechanical efficiency of the compressor can be increased and abrasion on an inner circumferential surface of the bearing can be suppressed. This may result in enhancing reliability of the compressor.

In addition, since a communication flow path is formed in the bearing protrusion portion, oil of discharge pressure or pressure almost equal to discharge pressure, can be quickly and smoothly supplied to a high-pressure side back pressure pocket and pressure pulsation in the back pressure pocket can also be reduced. Accordingly, it is possible to provide stable back pressure to a relevant vane by supplying the high-pressure oil to a back pressure chamber connected to the high-pressure side back pressure pocket. This can prevent a vane related to a discharge stroke from being separated from the cylinder, thereby preventing leakage between compression chambers. In addition, behavior of the vane can be stabilized, thereby reducing noise from the compressor caused by vane vibration.

Also, abrasion on a bearing or the rotation shaft can be suppressed as the bearing protrusion portion prevents foreign materials from entering a bearing surface even during long-time operation, thereby enhancing reliability of the compressor.

In a vane rotary compressor according to the present disclosure, when a high-pressure refrigerant such as R32, R410a, and CO2 is used, radial support to the rotation shaft can be enhanced although surface pressure against a bearing is higher than that when a medium to low pressure refrigerant such as R134a is used. This may result in preventing leakage between compression chambers and stabilizing behavior of the vane, thereby enhancing reliability of the vane rotary compressor using the high-pressure refrigerant.

In addition, in a vane rotary compressor according to the present disclosure, radial supporting force to a rotation shaft can be enhanced even under a low-temperature heating condition, a high pressure ratio condition, and a high-speed operation condition.

BRIEF DESCRIPTION OF THE DRAWINGS

FIG. 2 is a sectional view taken along line "IV-IV" of FIG. 1, and FIG. 3 is a sectional view taken along line "V-V" of FIG. 2.

DETAILED DESCRIPTION

Description will now be given in detail of a vane rotary compressor according to exemplary embodiments disclosed herein, with reference to the accompanying drawings.

Figure 1:
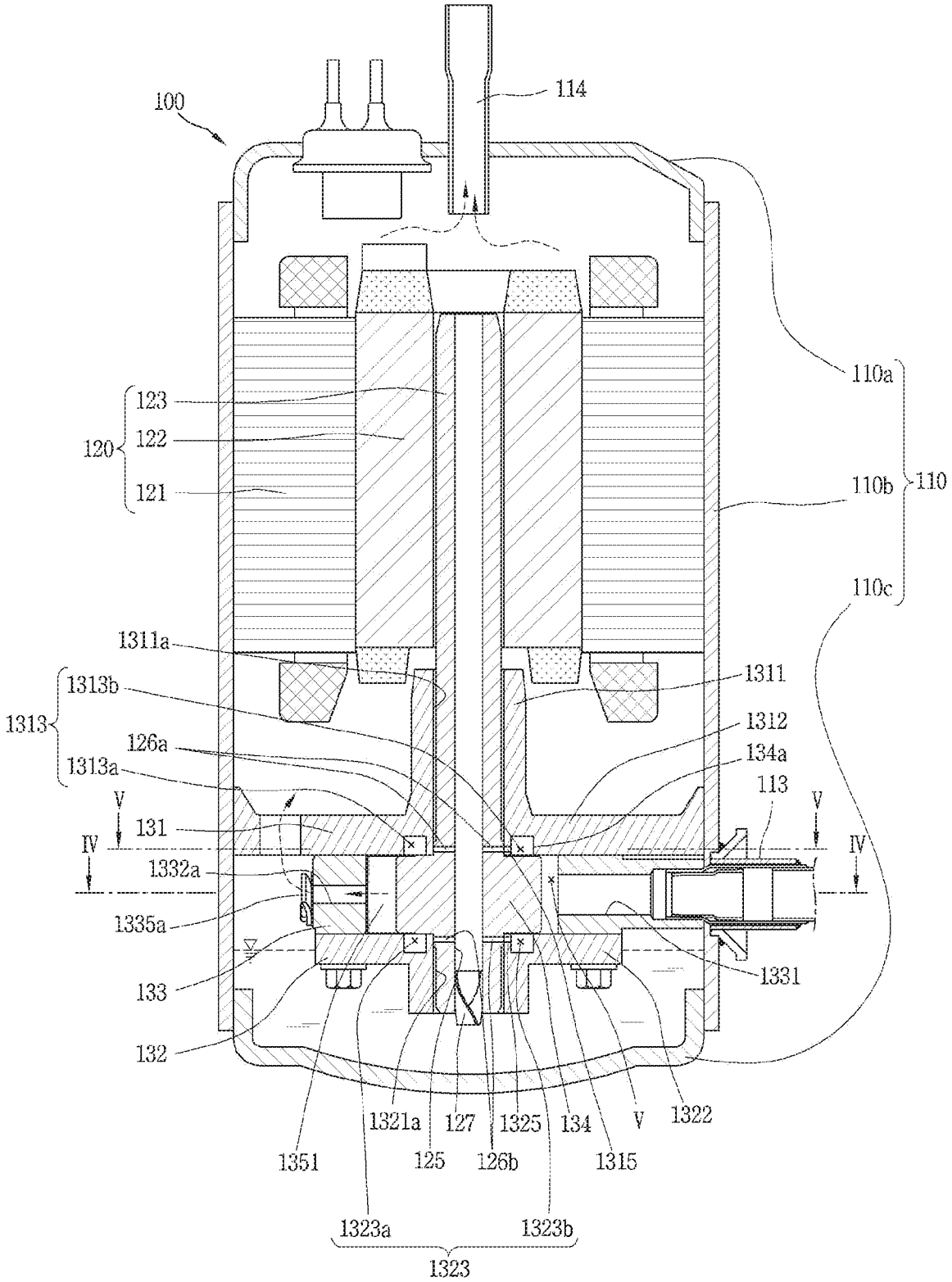
FIG. 1 is a longitudinal sectional view of an exemplary vane rotary compressor according to the present disclosure.
Figure 2:
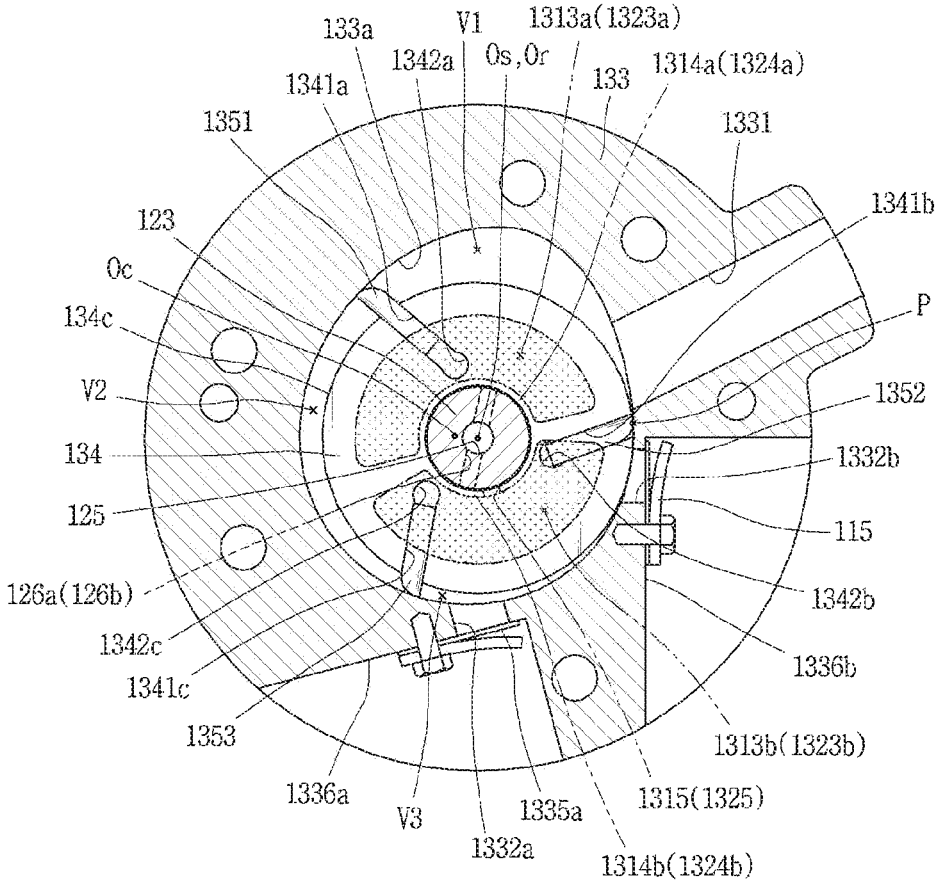
FIGS. 2 and 3 are horizontal sectional views of a compression unit of FIG. 1, namely.
Figure 3:
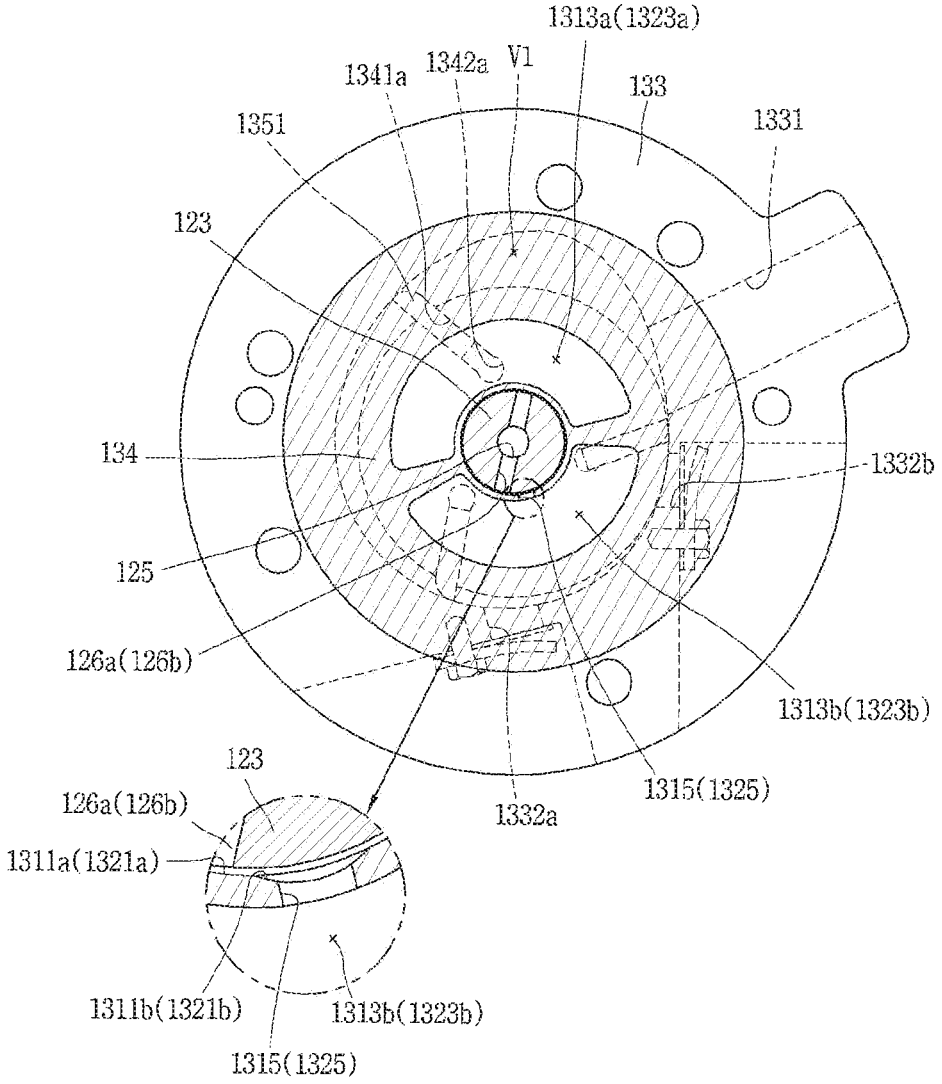

FIG. 1 is a longitudinal sectional view of an exemplary vane rotary compressor according to the present disclosure, and FIGS. 2 and 3 are horizontal sectional views of a compression unit of FIG. 1. FIG. 2 is a sectional view taken along line "IV-IV" of FIG. 1, and FIG. 3 is a sectional view taken along line "V-V" of FIG. 2.

Referring to FIG. 1, a vane rotary compressor according to the present disclosure includes a driving motor 120 installed in a casing 110 and a compression unit 130 provided at one side of the driving motor 120 and mechanically connected to each other by a rotation shaft 123.

The casing 110 may be classified as a vertical type or a horizontal type according to a compressor installation method. As for the vertical-type casing, the driving motor and the compression unit are disposed at both upper and lower sides along an axial direction. And as for the horizontal-type casing, the driving motor and the compression unit are disposed at both left and right sides.

The driving motor 120 provides power for compressing a refrigerant. The driving motor 120 includes a stator 121, a rotor 122, and a rotation shaft 123.

The stator 121 is fixedly inserted into the casing 110. The stator 121 may be mounted on an inner circumferential surface of the cylindrical casing 110 in a shrink-fitting manner or so. For example, the stator 121 may be fixedly mounted on an inner circumferential surface of an intermediate shell 110*b*.

The rotor 122 is disposed with being spaced apart from the stator 121 and located at an inner side of the stator 121. The rotation shaft 123 is press-fitted into a central part of the rotor 122. Accordingly, the rotation shaft 123 rotates concentrically together with the rotor 122.

An oil flow path 125 is formed in a central part of the rotation shaft 123 in an axial direction, and oil passage holes 126*a* and 126*b* are formed through a middle part of the oil flow path 125 toward an outer circumferential surface of the rotation shaft 123. The oil passage holes 126*a* and 126*b* include a first oil passage hole 126*a* belonging to a range of a first shaft receiving portion 1311 to be described later and a second oil passage hole 126*b* belonging to a range of a second shaft receiving portion 1321. Each of the first oil passage hole 126*a* and the second oil passage hole 126*b* may be provided by one or in plurality. In this embodiment, the first and second oil passage holes are provided in plurality, respectively.

An oil feeder 127 is installed at the middle or a lower end of the oil flow path 125. Accordingly, when the rotation shaft 123 rotates, oil filled in a lower part of the casing is pumped by the oil feeder 127 and is sucked along the oil flow path 125, so as to be introduced into a sub bearing surface 1321*a* with the second shaft receiving portion through the second oil passage hole 126*b* and into a main bearing surface 1311*a* with the second shaft receiving portion through the first oil passage hole 126*a*.

It is preferable that the first oil passage hole 126*a* and the second oil passage hole 126*b* are formed so as to overlap a first oil groove 1311*b* and a second oil groove 1321*b*, respectively, which are to be explained later. In this way, oil supplied to the bearing surfaces 1311*a* and 1321*a* of a main bearing 131 and a sub bearing 132 through the first oil passage hole 126*a* and the second oil passage hole 126*b* can be quickly introduced into a main-side second pocket 1313*b* and a sub-side second pocket 1323*b* to be explained later.

The compression unit 130 includes a cylinder 133 in which a compression space V is formed by the main bearing 131 and the sub bearing 132 installed on both sides of an axial direction.

Referring to FIGS. 1 and 2, the main bearing 131 and the sub bearing 132 are fixedly installed on the casing 110 and are spaced apart from each other along the rotation shaft 123. The main bearing 131 and the sub bearing 132 radially support the rotation shaft 123 and axially support the cylinder 133 and a roller 134 at the same time. As a result, the main bearing 131 and the sub bearing 132 may be provided with a shaft receiving portion 1311, 1321 radially supporting the rotation shaft 123, and a flange portion 1312, 1322 radially extending from the shaft receiving portion 1311, 1321. For convenience of explanation, the shaft receiving portion and the flange portion of the main bearing 131 are defined as the first bearing portion 1311 and the first flange portion 1312, respectively, and the shaft receiving portion and the flange portion of the sub bearing 132 are defined as the second bearing portion 1321 and the second flange portion 1322, receptively.

Referring to FIGS. 1 and 3, the first shaft receiving portion 1311 and the second shaft receiving portion 1321 are formed in a bush shape, receptively, and the first flange portion and the second flange portion are formed in a disk shape, respectively. A first oil groove 1311*b* is formed on a radial bearing surface (hereinafter, abbreviated as "bearing surface" or "first bearing surface") 1311*a*, which is an inner circumferential surface of the first shaft receiving portion 1311, and a second oil groove 1321*b* is formed on a radial bearing surface (hereinafter, abbreviated as "bearing surface" or "second bearing surface") 1321*a*, which is an inner circumferential surface of the second shaft receiving portion 1321. The first oil groove 1311*b* is formed linearly or diagonally between upper and lower ends of the first shaft receiving portion 1311, and the second oil groove 1321*b* is formed linearly or diagonally between upper and lower ends of the second shaft receiving portion 1321.

A first communication flow path 1315 to be described later is formed in the first oil groove 1311*b*, and a second communication flow path 1325 to be described later is formed in the second oil groove 1321*b*. The first communication flow path 1315 and the second communication flow path 1325 are provided for guiding oil flowing into the respective bearing surfaces 1311*a* and 1321*a* to a main-side back pressure pocket 1313 and a sub-side back pressure pocket 1323.

The first flange portion 1312 is provided with the main-side back pressure pocket 1313, and the second flange portion 1322 is provided with the sub-side back pressure pocket 1323. The main-side back pressure pocket 1313 is provided with a main-side first pocket 1313*a* and a main-side second pocket 1313*b*, and the sub-side back pressure pocket 1323 is provided with a sub-side first pocket 1323*a* and a sub-side second pocket 1323*b*.

The main-side first pocket 1313*a* and the main-side second pocket 1313*b* are formed with a predetermined spacing therebetween along a circumferential direction, and the sub-side first pocket 1323*a* and the sub-side second pocket 1323*b* are formed with a predetermined spacing therebetween along the circumferential direction.

The main-side first pocket 1313*a* has a pressure lower than a pressure in the main-side second pocket 1313*b*, for example, an intermediate pressure between suction pressure and discharge pressure. And the sub-side first pocket 1323*a* has pressure lower than a pressure in the sub-side second pocket 1323*b*, for instance, an intermediate pressure nearly the same as the pressure of the main-side first pocket 1313*a*. The main-side first pocket 1313*a* has intermediate pressure by being decompressed while oil is introduced into the main-side first pocket 1313*a* through a fine passage between a main-side first bearing protrusion portion 1314*a* and an upper surface 134*a* of the roller 134 to be described later, and the sub-side first pocket 1323*a* also has an intermediate pressure by being decompressed while oil is introduced into the sub-side first pocket 1323*a* through a fine passage between a sub-side first bearing protrusion portion 1324*a* and a lower surface 134*b* of the roller 134 to be described later. On the other hand, the main-side second pocket 1313*b* and the sub-side second pocket 1323*b* maintain discharge pressure or pressure almost equal to discharge pressure as oil, which is introduced into the main bearing surface 1311*a* and the sub bearing surface 1321*a* through the first oil passage hole 126*a* and the second oil passage hole 126*b*, flows into the main-side second pocket 1313*b* and the sub-side second pocket 1323*b* through the first communication flow path 1315 and the second communication flow path 1325 to be described later.

An inner circumferential surface, which constitutes a compression space V, of a cylinder 133 is formed in an elliptical shape. The inner circumferential surface of the cylinder 133 may be formed in a symmetric elliptical shape having a pair of major and minor axes. However, the inner circumferential surface of the cylinder 133 has an asymmetric elliptical shape having multiple pairs of major and minor axes in this embodiment of the present disclosure. This cylinder 133 formed in the asymmetric elliptical shape is generally referred to as a hybrid cylinder, and this embodiment describes a vane rotary compressor to which such a hybrid cylinder is applied. However, a back pressure pocket structure according to the present disclosure is equally applicable to a vane rotary compressor with a cylinder with a symmetric elliptical shape.

As illustrated in FIGS. 2 and 3, an outer circumferential surface of the hybrid cylinder (hereinafter, abbreviated simply as "cylinder") 133 according to this embodiment may be formed in a circular shape. However, a non-circular shape may also be applied if it is fixed to an inner circumferential surface of the casing 110. Of course, the main bearing 131 and the sub bearing 132 may be fixed to the inner circumferential surface of the casing 110, and the cylinder 133 may be coupled to the main bearing 131 or the sub bearing 132 fixed to the casing 110 with a bolt.

In addition, an empty space is formed in a central portion of the cylinder 133 so as to form a compression space V including an inner circumferential surface. This empty space is sealed by the main bearing 131 and the sub bearing 132 to form the compression space V. The roller 134 to be described later is rotatably coupled to the compression space V.

The inner circumferential surface 133*a* of the cylinder 133 is provided with an inlet port 1331 and outlet ports 1332*a* and 1332*b* on both sides of a circumferential direction with respect to a point where the inner circumferential surface 133*a* of the cylinder 133 and an outer circumferential surface 134*c* of the roller 134 are almost in contact with each other.

The inlet port 1331 is directly connected to a suction pipe 113 penetrating through the casing 110, and the outlet ports 1332*a* and 1332*b* communicates with an inner space of the casing 110, thereby being indirectly connected to a discharge pipe 114 coupled to the casing 110 in a penetrating manner. Accordingly, a refrigerant is sucked directly into the compression space V through the inlet port 1331 while a compressed refrigerant is discharged into the inner space of the casing 110 through the outlet ports 1332*a* and 1332*b*, and is then discharged to the discharge pipe 114. As a result, the inner space of the casing 110 is maintained in a high-pressure state forming discharge pressure.

In addition, the inlet port 1331 is not provided with an inlet valve, separately, however, the outlet ports 1332*a* and 1332*b* are provided with discharge valves 1335*a* and 1335*b*, respectively, for opening and closing the outlet ports 1332*a* and 1332*b*. The discharge valves 1335*a* and 1335*b* may be a lead-type valve having one end fixed and another end free. However, various types of a valve such as a piston valve, other than a lead type valve, may be used for the discharge valves 1335*a* and 1335*b* as necessary.

When the lead-type valve is used for discharge valves 1335*a* and 1335*b*, valve grooves 1336*a* and 1336*b* are formed on an outer circumferential surface of the cylinder 133 so as to mount the discharge valves 1335*a* and 1335*b*. Accordingly, the length of the outlet ports 1332*a* and 1332*b* is reduced to minimum, thereby decreasing in dead volume. The valve grooves 1336*a* and 1336*b* may be formed in a triangular shape so as to secure a flat valve seat surface as illustrated in FIGS. 2 and 3.

Meanwhile, for the plurality of outlet ports 1332*a* and 1332*b* is formed along a compression passage (a compression proceeding direction). For convenience of explanation, an outlet port located at an upstream side of the compression passage is referred to as a sub outlet port (or a first outlet port) 1332*a*, and an outlet port located at a downstream side of the compression passage is referred to as a main outlet port (or a second outlet port) 1332*b*.

However, the sub outlet port is not necessarily required and may be selectively formed as necessary. For example, the sub outlet port may not be formed on the inner circumferential surface 133*a* of the cylinder 133 if over compression of a refrigerant is appropriately reduced by forming a long compression period. However, the sub outlet port 1332*a* may be formed at a front part of the main outlet port 1332*b*, that is, at an upstream part of the main outlet port 1332*b* based on the compression proceeding direction in order to minimize an amount of refrigerant over compressed.

Referring to FIGS. 2 and 3, the roller 134 is rotatably provided in the compression space V of the cylinder 133. The outer circumferential surface 134*c* of the roller 134 is formed in a circular shape, and the rotation shaft 123 is integrally coupled to a central part of the roller 134. In this way, the roller 134 has a center Or coinciding with an axial center Os of the rotation shaft 123, and concentrically rotates together with the rotation shaft 123 centering around the center Or of the roller 134.

The center Or of the roller 134 is eccentric with respect to a center Oc of the cylinder 133, that is, a center of the inner space of the cylinder 133 (hereinafter, referred to as "the center of the cylinder"), and one side of the outer circumferential surface 134*c* of the roller 134 is almost in contact with the inner circumferential surface 133*a* of the cylinder 133. Here, when an arbitrary point of the cylinder 133 where one side of the outer circumferential surface of the roller 134 is closest to the inner circumferential surface of the cylinder 133 and the roller 134 almost comes into contact with the cylinder 133 is referred to as a contact point P, a central line passing through the contact point P and the center of the cylinder 133 may be a position for a minor axis of the elliptical curve forming the inner circumferential surface 133*a* of the cylinder 133.

The roller 134 has a plurality of vane slots 1341*a*, 1341*b* and 1341*c* formed in an outer circumferential surface thereof at appropriate places along a circumferential direction. And vanes 1351, 1352 and 1353 are slidably inserted into the vane slots 1341*a*, 1341*b* and 1341*c*, respectively. The vane slots 1341*a*, 1341*b*, and 1341*c* may be formed in a radial direction with respect to the center of the roller 134. In this case, however, it is difficult to sufficiently secure a length of the vane. Therefore, the vane slots 1341*a*, 1341*b*, and 1341*c* may preferably be formed to be inclined at a predetermined inclination angle with respect to the radial direction in that the length of the vane can be sufficiently secured.

Here, a direction to which the vanes 1351, 1352 and 1353 are tilted is an opposite direction to a rotation direction of the roller 134, that is, the front end surface of the vanes 1351, 1352, and 1353 in contact with the inner circumferential surface 133*a* of the cylinder 133 is tilted in the rotation direction of the roller 134. This is preferable in that a compression start angle can be moved forward in the rotation direction of the roller 134 so that compression can start quickly.

In addition, back pressure chambers 1342*a*, 1342*b* and 1342*c* are formed at inner ends of the vanes 1351, 1352 and 1353, respectively, to introduce oil (or to refrigerant) into a rear side of the vane slots 1341*a*, 1341*b*, and 1341*c* so as to push each vane toward the inner circumferential surface of the cylinder 133. For convenience of explanation, a direction toward the cylinder with respect to a movement direction of the vane is defined as a forward direction, and an opposite direction is defined as a backward direction.

The back pressure chambers 1342*a*, 1342*b* and 1342*c* are hermetically sealed by the main bearing 131 and the sub bearing 132. The back pressure chambers 1342*a*, 1342*b* and 1342*c* may independently communicate with the back pressure pockets 1313 and 1323, or the plurality of back pressure chambers 1342*a*, 1342*b* and 1342*c* may be formed to communicate together through the back pressure pockets 1313 and 1323.

The back pressure pockets 1313 and 1323 may be formed in the main bearing 131 and the sub bearing 132, respectively, as shown in FIG. 1. In some cases, however, they may be formed in only one bearing of the main bearing 131 and the sub bearing 132. In this embodiment of the present disclosure, the back pressure pockets 1313 and 1323 are formed in both the main bearing 131 and the sub bearing 132. For convenience of explanation, the back pressure pocket formed in the main bearing is defined as a main-side back pressure pocket 1313, and the back pressure pocket formed in the sub bearing 132 is defined as a sub-side back pressure pocket 1323.

As described above, the main-side back pressure pocket 1313 is provided with the main-side first pocket 1313*a* and the main-side second pocket 1313*b*, and the sub-side back pressure pocket 1323 is provided with the sub-side first pocket 1323*a* and the sub-side second pocket 1323*b*. Also, the second pockets of both the main side and the sub side form higher pressure compared to the first pockets. Accordingly, the main-side first pocket 1313*a* and the sub-side first pocket 1323*a* communicate with a back pressure chamber to which a vane located relatively at an upstream side (from the discharge stroke to the suction stroke) of the vanes is belonged, and the main-side second pocket 1313*b* and the sub-side second pocket 1323*b* communicate with a back pressure chamber to which a vane located relatively at a downstream side (from the suction stroke to the discharge stroke) of the vanes is belonged.

If the vanes 1351, 1352 and 1353 are defined sequentially as a first vane 1351, a second vane 1352, and a third vane 1353 starting from the contact point P in the compression proceeding direction, an interval corresponding to the circumferential angle is formed between the first vane 1351 and the second vane 1352, between the second vane 1352 and the third vane 1353, and between the third vane 1353 and the first vane 1351.

Accordingly, when a compression chamber formed between the first vane 1351 and the second vane 1352 is a first compression chamber V1, a compression chamber formed between the second vane 1352 and the third vane 1353 is a second compression chamber V2, and a compression chamber formed between the third vane 1353 and the first vane 1351 is a third compression chamber V3, all of the compression chambers V1, V2, and V3 have the same volume at the same crank angle.

The vanes 1351, 1352, and 1353 are formed in a substantially rectangular shape. Here, of both end surfaces of the vane in a lengthwise direction of the vane, a surface in contact with the inner circumferential surface 133*a* of the cylinder 133 is defined as a front surface of the vane, and a surface facing the back pressure chamber 1342*a*, 1342*b*, 1342*c* is defined as a rear surface of the vane.

The front surface of each of the vanes 1351, 1352 and 1353 is curved so as to be in line contact with the inner circumferential surface 133*a* of the cylinder 133, and the rear surface of the vane 1351, 1352 and 1353 is formed flat to be inserted into the back pressure chamber 1342*a*, 1342*b*, 1342*c* and to evenly receive back pressure.

In the drawings, reference numerals 110*a* and 110*c* (see FIG. 1) denote an upper shell and a lower shell, receptively.

In the vane rotary compressor according to the present disclosure, when power is applied to the driving motor 120 so that the rotor 122 of the driving motor 120 and the rotation shaft 123 coupled to the rotor 122 rotate together, the roller 134 rotates together with the rotation shaft 123.

Then the vanes 1351, 1352 and 1353 are pulled out from the respective vane slots 1341*a*, 1341*b*, and 1341*c* by a centrifugal force generated due to the rotation of the roller 134 and back pressure of the back pressure chambers 1342*a*, 1342*b*, 1342*c* provided at the rear side of the vanes 1351, 1352, and 1353. Accordingly, the front surface of each of the vanes 1351, 1352, and 1353 is brought into contact with the inner circumferential surface 133*a* of the cylinder 133.

Then the compression space V of the cylinder 133 is divided by the plurality of vanes 1351, 1352, and 1353 into a plurality of compression chambers (including a suction chamber or a discharge chamber) V1, V2, and V3 as many as the number of vanes 1351, 1352 and 1353. The volume of each compression chamber V1, V2 and V3 changes according to a shape of the inner circumferential surface 133*a* of the cylinder 133 and eccentricity of the roller 134 while moving in response to the rotation of the roller 134. A refrigerant filled in each of the compression chambers V1, V2, and V3 then flows along the roller 134 and the vanes 1351, 1352, and 1353 so as to be sucked, compressed and discharged.

This will be described in more detail as follows. FIGS. 4A-4D are sectional views illustrating processes of sucking, compressing, and discharging a refrigerant in a cylinder according to the embodiment of the present disclosure. In FIGS. 4A-4D, the main bearing is projected, and the sub bearing not shown is the same as the main bearing.

Figure 4A:
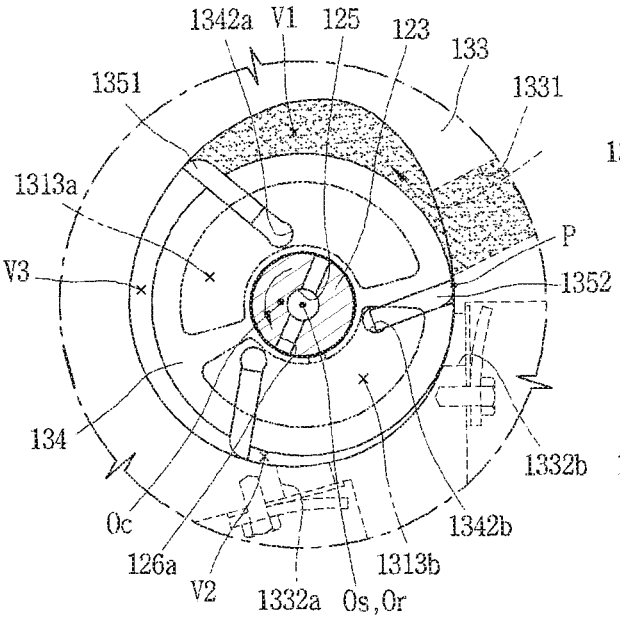
FIGS. 4A-4D are sectional views illustrating processes of sucking, compressing and discharging a refrigerant in a cylinder according to an embodiment of the present disclosure.

As illustrated in FIG. 4A, the volume of the first compression chamber V1 continuously increases until before the first vane 1351 passes through the inlet port 1331 and the second vane 1352 reaches a suction completion time, so that a refrigerant is continuously introduced into the first compression chamber V1 from the inlet port 1331.

At this time, the first back pressure chamber 1342*a* provided at the rear side of the first vane 1351 is exposed to the first pocket 1313*a* of the main-side back pressure pocket 1313, and the second back pressure chamber 1342*b* provided at the rear side of the second vane 1352 is exposed to the second pocket 1313*b* of the main-side back pressure pocket 1313. Accordingly, the first back pressure chamber 1342*a* forms intermediate pressure and the second back pressure chamber 1342*b* forms discharge pressure or pressure almost equal to discharge pressure (hereinafter, referred to as "discharge pressure"). The first vane 1351 is pressurized by the intermediate pressure and the second vane 1352 is pressurized by the discharge pressure, respectively, to be brought into close contact with the inner circumferential surface of the cylinder 133.

Figure 4B:
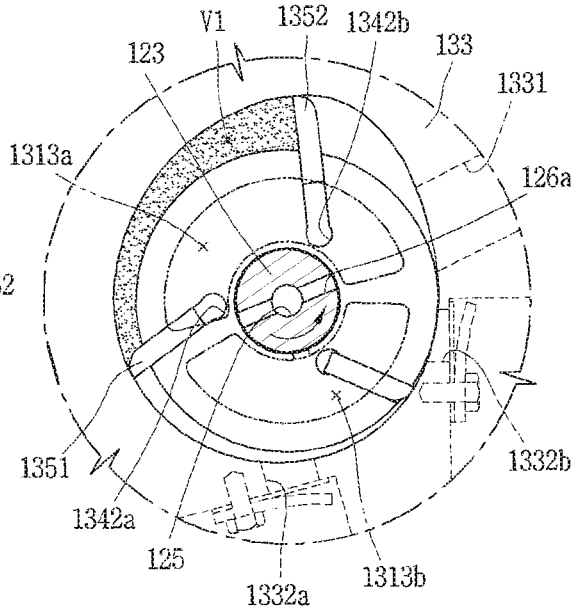

As illustrated in FIG. 4B, when the second vane 1352 performs a compression stroke after passing the suction completion time (or the compression start angle), the first compression chamber V1 is in a sealed state and moves in a direction toward the outlet port together with the roller 134. In this process, the volume of the first compression chamber V1 is continuously decreased and a refrigerant in the first compression chamber V1 is gradually compressed.

At this time, when refrigerant pressure in the first compression chamber V1 rises, the first vane 1351 may be pushed toward the first back pressure chamber 1342*a*. As a result, the first compression chamber V1 communicates with the preceding third chamber V3, which may cause refrigerant leakage. Therefore, higher back pressure needs to be formed in the first back pressure chamber 1342*a* in order to prevent the refrigerant leakage.

Referring to the drawings, the first back pressure chamber 1342*a* is about to enter the main-side second pocket 1313*b* after passing the main-side first pocket 1313*a*. Accordingly, back pressure formed in the first back pressure chamber 1342*a* immediately rises to discharge pressure from intermediate pressure. As the back pressure of the first back pressure chamber 1342*a* increases, it is possible to suppress the first vane 1351 from being pushed backwards.

Figure 4C:
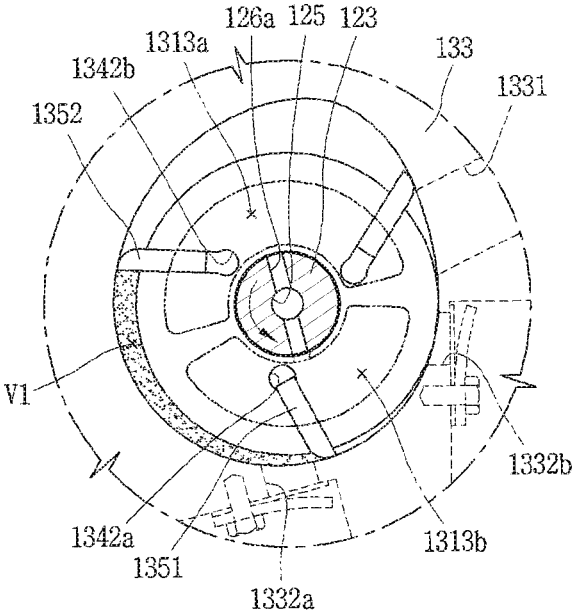

As illustrated in FIG. 4C, when the first vane 1351 passes through the first outlet port 1332*a* and the second vane 1352 has not reached the first outlet port 1332*a*, the first compression chamber V1 communicates with the first outlet port 1332*a* and the first outlet port 1332*a* is opened by pressure of the first compression chamber V1. Then a part of a refrigerant in the first compression chamber V1 is discharged to the inner space of the casing 110 through the first outlet port 1332*a*, so that the pressure of the first compression chamber V1 is lowered to predetermined pressure. In the case of no first outlet port 1332*a*, a refrigerant in the first compression chamber V1 further moves toward the second outlet port 1332*b*, which is the main outlet port, without being discharged from the first compression chamber V1.

At this time, the volume of the first compression chamber V1 is further decreased so that the refrigerant in the first compression chamber V1 is further compressed. However, the first back pressure chamber 1342*a* in which the first vane 1351 is accommodated fully communicates with the main-side second pocket 1313*b* so as to form pressure almost equal to discharge pressure. Accordingly, the first vane 1351 is not pushed by back pressure of the first back pressure chamber 1342*a*, thereby suppressing leakage between compression chambers.

Figure 4D:
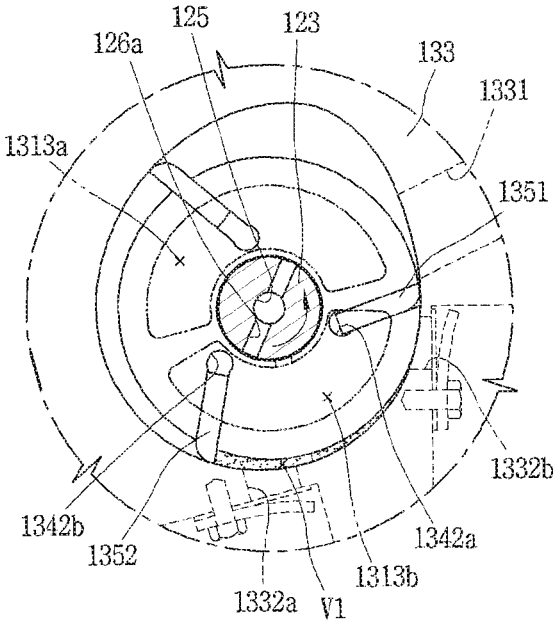

As illustrated in FIG. 4D, when the first vane 1351 passes through the second outlet port 1332*b* and the second vane 1352 reaches a discharge start angle, the second outlet port 1332*b* is opened by refrigerant pressure in the first compression chamber V1. Then the refrigerant in the first compression chamber V1 is discharged to the inner space of the casing 110 through the second outlet port 1332*b*.

At this time, the first back pressure chamber 1342*a* is about to enter the main-side first pocket 1313*a* as an intermediate pressure region after passing the main-side second pocket 1313*b* as a discharge pressure region. Accordingly, back pressure formed in the first back pressure chamber 1342*a* is to be lowered to intermediate pressure from discharge pressure.

Meanwhile, the second back pressure chamber 1342*b* is located in the main-side second pocket 1313*b*, which is the discharge pressure region, and back pressure corresponding to discharge pressure is formed in the second back pressure chamber 1342*b*.

Figure 5:
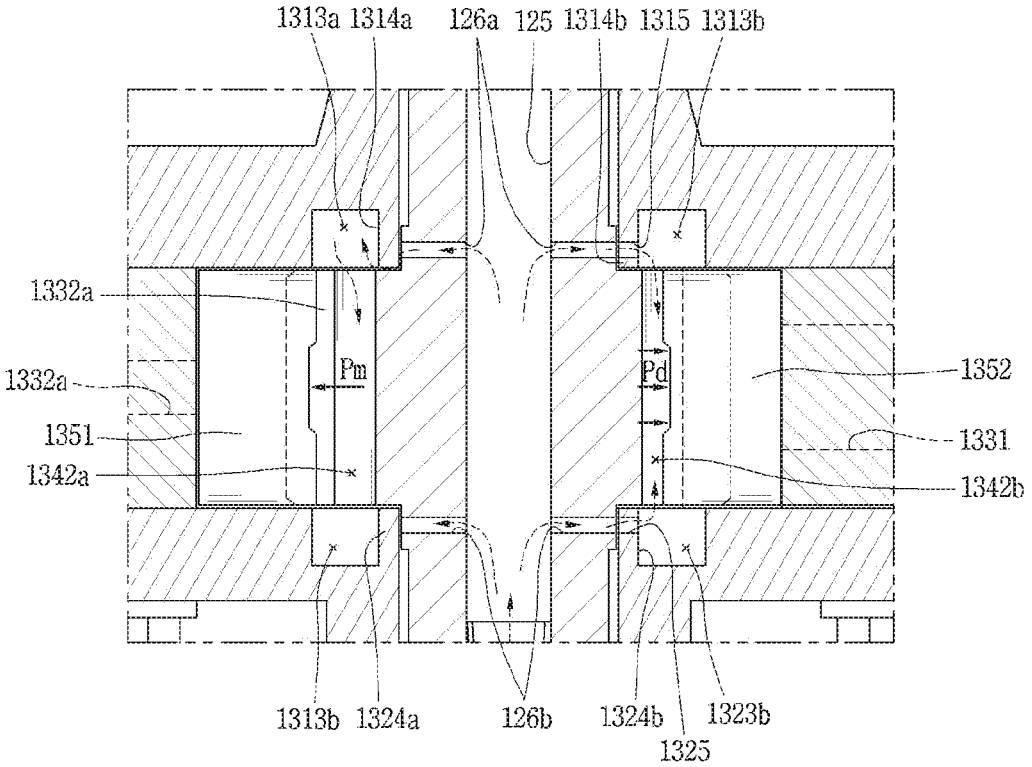
FIG. 5 is a longitudinal sectional view of a compression unit for explaining back pressure of each back pressure chamber in the vane rotary compressor according to the present disclosure.

FIG. 5 is a longitudinal sectional view of a compression unit for explaining back pressure of each back pressure chamber in the vane rotary compressor according to the present disclosure.

Referring to FIG. 5, intermediate pressure Pm between suction pressure and discharge pressure is formed at a rear end portion of the first vane 1351 positioned in the main-side first pocket 1313*a*, and discharge pressure Pd (actually pressure slightly lower than the discharge pressure) is formed at a rear end portion of the second vane 1352 positioned in the second pocket 1313*b*. In particular, as the main-side second pocket 1313*b* directly communicates with the oil flow path 125 through the first oil passage hole 126*a* and the first communication flow path 1315, pressure of the second back pressure chamber 1342*b* communicating with the main-side second pocket 1313*b* can be prevented from rising above the discharge pressure Pd.

Accordingly, intermediate pressure Pm, which is much lower than the discharge pressure Pd, is formed in the main-side first pocket 1313*a*, thereby enhancing mechanical efficiency between the cylinder 133 and the vane 135. And as pressure equal to or slightly lower than the discharge pressure Pd is formed in the main-side second pocket 1313*b*, the vane is properly brought into close contact with the cylinder, thereby enhancing mechanical efficiency while suppressing leakage between compression chambers.

Meanwhile, the first pocket 1313*a* and the second pocket 1313*b* of the main-side back pressure pocket 1313 according to this embodiment communicate with the oil flow path 125 via the first oil passage hole 126*a*, and the first pocket 1323*a* and the second pocket 1323*b* of the sub-side back pressure pocket 1323 communicate with the oil flow path 125 via the second oil passage hole 126*b*.

Referring back to FIGS. 2 and 3, the main-side first pocket 1313*a* and the sub-side first pocket 1323*a* are closed by the main-side and sub-side first bearing protrusion portions 1314*a* and 1324*a* with respect to the bearing surfaces 1311*a* and 1321*a* that the main-side and sub-side first pockets 1313*a* and 1323*a* face, respectively. Accordingly, oil (refrigerant mixed oil) in the main-side and sub-side first pockets 1313*a* and 1323*a* flows into the bearing surfaces 1311*a* and 1321*a* through the respective oil passage holes 126*a* and 126*b*, and is decompressed while passing through a gap between the main-side and sub-side first bearing protrusion portions 1314*a* and 1324*a* and the opposite upper surface 134*a* or lower surface 134*b* of the roller 134, resulting in forming intermediate pressure.

On the other hand, the main-side and sub-side second pockets 1313*b* and 1323*b* communicate with the respective bearing surfaces 1311*a* and 1321*a*, which the second pockets face, by the main-side and sub-side second bearing protrusion portions 1314*b* and 1324*b*. Accordingly, oil (refrigerant mixed oil) in the main-side and sub-side second pockets 1313*b* and 1323*b* flows into the bearing surfaces 1311*a* and 1321*a* through the respective oil passage holes 126*a* and 126*b*, and is introduced into the respective second pockets 1313*b* and 1323*b* via the main-side and sub-side bearing protrusion portions 1314*b* and 1324*b*, thereby forming pressure equal to or slightly lower than the discharge pressure.

However, in the embodiment of the present disclosure, the main-side second pocket 1313*b* and the sub-side second pocket 1323*b* do not communicate in a fully opened state with the bearing surfaces 1311*a* and 1321*a*, which the pockets face, respectively. In other words, the main-side second bearing protrusion portion 1314*b* and the sub-side second bearing protrusion portion 1324*b* mostly block the main-side second pocket 1313*b* and the sub-side second pocket 1323*b*, however, partially block the respective second pockets 1313*b* and 1323*b* with the communication flow paths 1315 and 1325 interposed therebetween.

Figure 6:
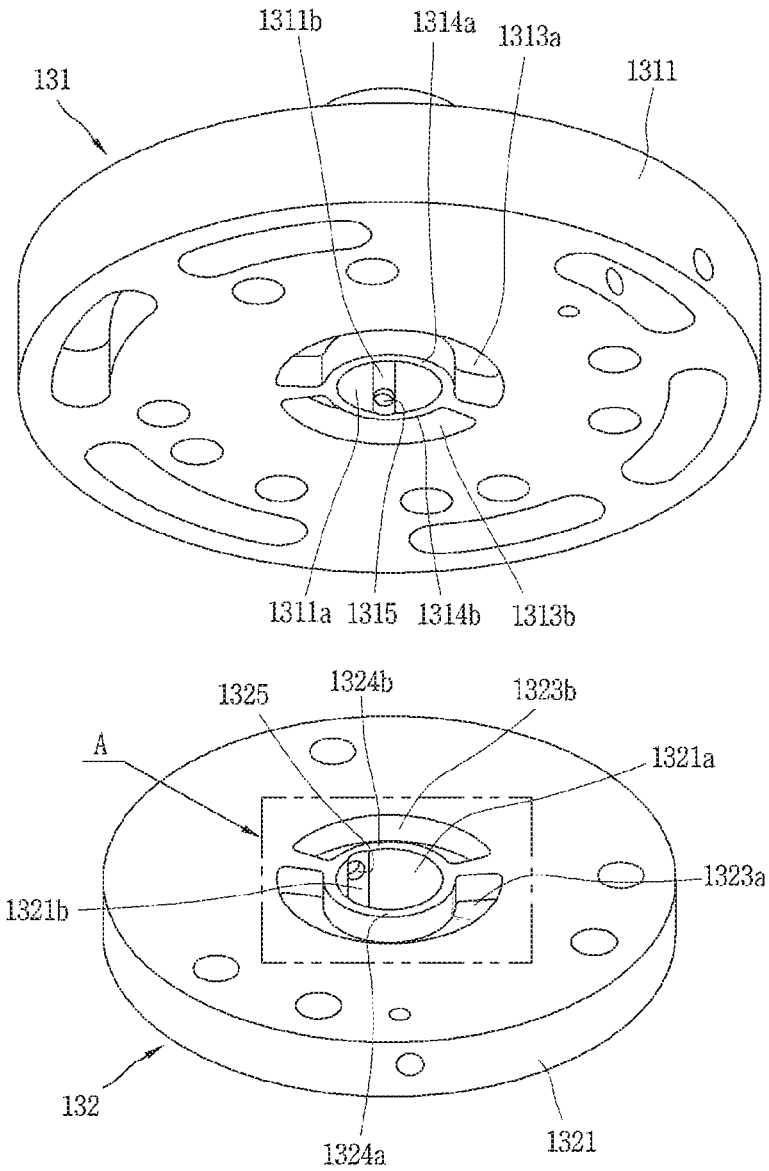
FIG. 6 is a disassembled perspective view of a main bearing and a sub bearing for explaining back pressure pockets according to the present disclosure.

Meanwhile, the main-side back pressure pocket and the sub-side back pressure pocket according to the embodiment of the present disclosure may be formed as follows. FIG. 6 is a disassembled perspective view illustrating a main bearing and a sub bearing for explaining back pressure pockets according to the present disclosure.

Referring to FIG. 6, the flange portion 1312 of the main bearing 131 is provided with the main-side first pocket 1313*a* and second pocket 1313*b* formed along a circumferential direction with a predetermined distance therebetween, and the flange portion 1322 of the sub bearing 132 is provided with the main-side first pocket 1323*a* and second pocket 1323*b* formed along the circumferential direction with a predetermined distance therebetween.

Inner circumferential sides of the main-side first pocket 1313*a* and the second pocket 1313*b* are blocked by the main-side first bearing protrusion portion 1314*a* and the main-side second bearing protrusion portion 1314*b*, respectively. And inner circumferential sides of the sub-side first pocket 1323*a* and the second pocket 1323*b* are blocked by the sub-side first bearing protrusion portion 1324*a* and the sub-side second bearing protrusion portion 1324*b*, respectively.

Accordingly, the shaft receiving portion 1311 of the main bearing 131 forms a cylindrical bearing surface 1311*a*, which is formed by a substantially continuous surface, and the shaft receiving portion 1321 of the sub bearing 132 forms a cylindrical bearing surface 1321*a*, which is formed by a substantially continuous surface. In addition, the main-side first bearing protrusion portion 1314*a* and second bearing protrusion portion 1314*b*, and the sub-side first bearing protrusion portion 1324*a* and second bearing protrusion portion 1324*b* form a kind of elastic bearing surface.

The first oil groove 1311*b* is formed on the bearing surface 1311*a* of the main bearing 131 and the second oil groove 1321*b* is formed on the bearing surface 1321*a* of the sub bearing 132.

The main-side second bearing protrusion portion 1314*b* is provided with the first communication flow path 1315 for communicating the main-side bearing surface 1311*a* with the main-side second pocket 1313*b*. And the sub-side second bearing protrusion portion 1324*b* is provided with the second communication flow path 1325 for communicating the sub-side bearing surface 1321*a* with the sub-side second pocket 1323*b*.

The first communication flow path 1315 is formed at a position where it overlaps the main-side second bearing protrusion portion 1315*b* and the first oil groove 1311*b* at the same time, and the second communication flow path 1325 is formed at a position where it overlaps the sub-side second bearing protrusion portion 1324*b* and the second oil groove 1321*b* at the same time.

As shown in the drawings, the main-side back pressure pocket 1313 and the sub-side back pressure pocket 1323 according to the embodiment of the present disclosure have the same configuration or operation effects. Accordingly, hereinafter, the sub-side back pressure pocket 1323 will be described as a representative example for the sake of convenience, and the description of the sub-side back pressure pocket 1323 will be equally applied to the main-side back pressure pocket 1313.

Figure 7:
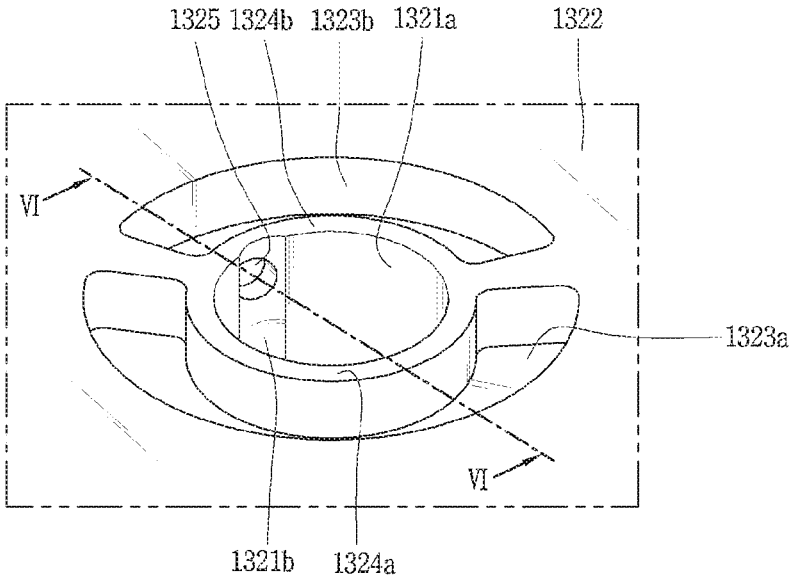
FIG. 7 is an enlarged perspective view illustrating a portion "A" of FIG. 6.
Figure 8:
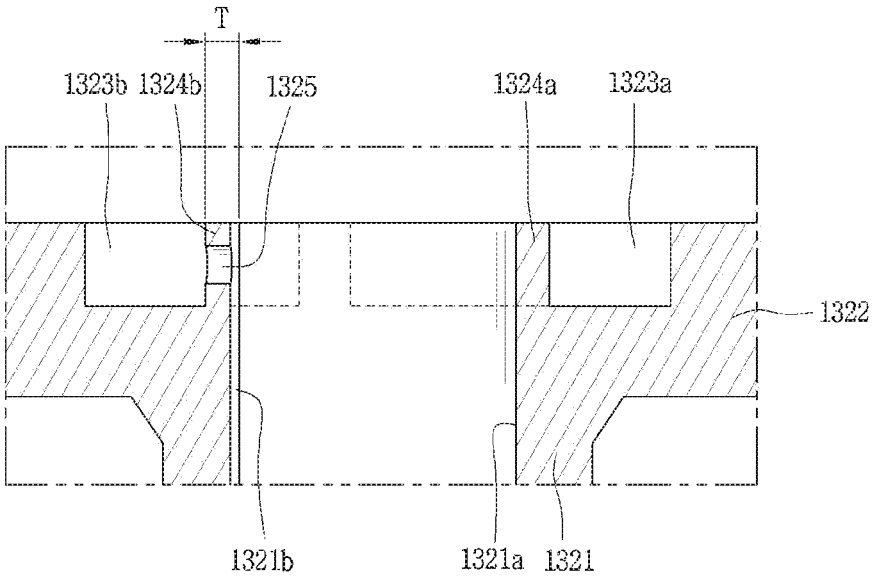
FIG. 8 is a sectional view taken along line "VI-VI" of FIG. 7.
Figure 9:
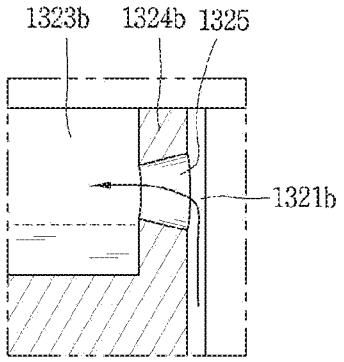
FIG. 9 is a sectional view illustrating another embodiment of a communication flow path of FIG. 8 according to the present disclosure.

FIG. 7 is an enlarged perspective view of a part "A" of FIG. 6, FIG. 8 is a sectional view taken along line "VI-VI" of FIG. 7, and FIG. 9 is a sectional view illustrating another embodiment of a communication flow path of FIG. 8.

Referring to FIGS. 7 and 8, the first pocket 1323*a* and the second pocket 1323*b* of the sub-side back pressure pocket 1323 are formed on the flange portion 1322 of the sub bearing 132 facing the lower surface 134*b* of the roller 134. Therefore, inner circumferential surfaces of the first bearing protrusion portion 1324*a* and of the second bearing protrusion portion 1324*b*, which form inner circumferential surfaces of the first pocket 1323*a* and the second pocket 1323*b* and block between the respective pockets 1323*a* and 1323*b* and the sub-bearing surface 1321*a*, form an inner circumferential surface of the second shaft receiving portion 1321, respectively.

The first pocket 1323*a* and the second pocket 1323*b* each formed in an arc shape are arranged along a circumferential direction. Outer wall surfaces of the first pocket 1323*a* and the second pocket 1323*b* are determined at the same time when an inner diameter of the cylinder 133 and an outer diameter of the roller 134 are determined. An outer diameter of the first pocket 1323*a* is the same as of the second pocket 1323*b*.

However, an arc length of the first pocket 1323*a*, which is the length between both side wall surfaces of the first pocket 1323*a* in the circumferential direction, is longer than that of the second pocket 1323*b*. This is because the first pocket 1323*a* involves in a suction stroke and most of a compression stroke, whereas the second pocket 1323*b* involves in the rest of the compression stroke and a discharge stroke.

The first bearing protrusion portion 1324*a* and the second bearing protrusion portion 1324*b* may have the same curvature and width. Particularly, since the width T of the first bearing protrusion portion 1324*a* and the second bearing protrusion portion 1324*b* serves to seal the first pocket 1323*a* and the second pocket 1323*b*, respectively, it is preferable to have a sealing length of about 1.5 mm.

The first bearing protrusion portion 1324*a* and the second bearing protrusion portion 1324*b* have the same height in an axial direction but the second communication flow path 1325 may be formed on an upper end surface of the second bearing protrusion portion 1324*b*.

As shown in FIG. 7, the second communication flow path 1325 may be formed as a communication hole penetrating from an inner circumferential surface to an outer circumferential surface of the second bearing protrusion 1324*b*. As shown in FIG. 8, the second communication flow path 1325 may be formed such that an inner circumferential side has the same cross-sectional area as of an outer circumferential side of the communication hole.

However, in some cases, as shown in FIG. 9, the cross-sectional area of the inner circumferential surface side of the communication hole may be larger than that of the outer circumferential surface side. Accordingly, oil can be quickly and smoothly introduced into the second pocket 1323*b* to be effectively stored in the second pocket 1323*b*. In this way, oil can be continuously supplied to the back pressure chamber communicating with the second pocket 1323*b* without interruption.

It is much preferable that the second communication flow path 1325 is formed on an upper half of the second bearing protrusion portion 1324*b* in that oil can be effectively retained in the second pocket 1323*b*.

In the vane rotary compressor according to the embodiment of the present disclosure, as a continuous bearing surface is substantially formed on the main-side second pocket 1313*b* and the sub-side second pocket 1323*b*, behavior of the rotation shaft 123 is stabilized, thereby enhancing mechanical efficiency of the compressor.

In addition, except for the communication flow path, the main-side second pocket 1313*b* and the sub-side second pocket 1323*b* are mostly closed by the main-side second bearing protrusion portion 1314*b* and the sub-side second bearing protrusion portion 1324*b*. Therefore, the main-side second pocket 1313*b* and the sub-side second pocket 1323*b* maintain a constant volume. Accordingly, pressure pulsation of back pressure for supporting the vane in the main-side second pocket 1313*b* and the sub-side second pocket 1323*b* can be lowered to stabilize behavior of the vane while suppressing vibration. As a result, collision noise between the vane and the cylinder can be reduced, and leakage between compression chambers can be reduced, thereby improving compression efficiency.

In addition, it is also possible to prevent foreign materials from being introduced into the main-side second pocket 1313*b* and the sub-side second pocket 1323*b* and accumulated between the bearing surfaces 1311*a* and 1321*a* and the rotation shaft 123 even during long-time operation. This may result in preventing abrasion on the bearings 131 and 132 or the rotation shaft 123.

In the vane rotary compressor according to the embodiment of the present disclosure, when a high-pressure refrigerant such as R32, R410a, and CO2 is used, the radial supporting force to the rotation shaft 123 can increase as described above although surface pressure against the bearing may be higher than that when a medium to low pressure refrigerant such as R134a is used. Also, as for the high-pressure refrigerant, surface pressure against the vane rises as well, which may cause leakage between compression chambers or vibration. However, contact force between the vanes 1351, 1352 and 1353 and the cylinder 133 can be appropriately maintained by maintaining back pressure of the back pressure chambers according to each vane. As a result, leakage between compression chambers and vane vibration can be suppressed. Therefore, reliability of the vane rotary compressor using the high-pressure refrigerant can be enhanced.

In the vane rotary compressor according to the embodiment of the present disclosure, the radial supporting force to the rotation shaft can be enhanced even under a low-temperature heating condition, a high pressure ratio condition, and a high-speed operation condition.

Hereinafter, description will be given of another embodiment of a communication flow path in a vane rotary compressor according to the present disclosure.

Figure 10:
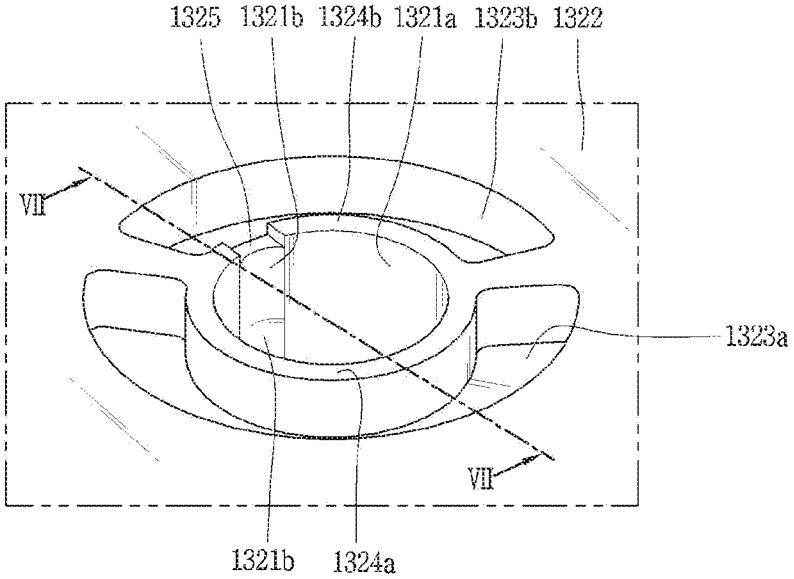
FIG. 10 is a perspective view illustrating another embodiment of a part "A" of FIG. 6 according to the present disclosure.
Figure 11:
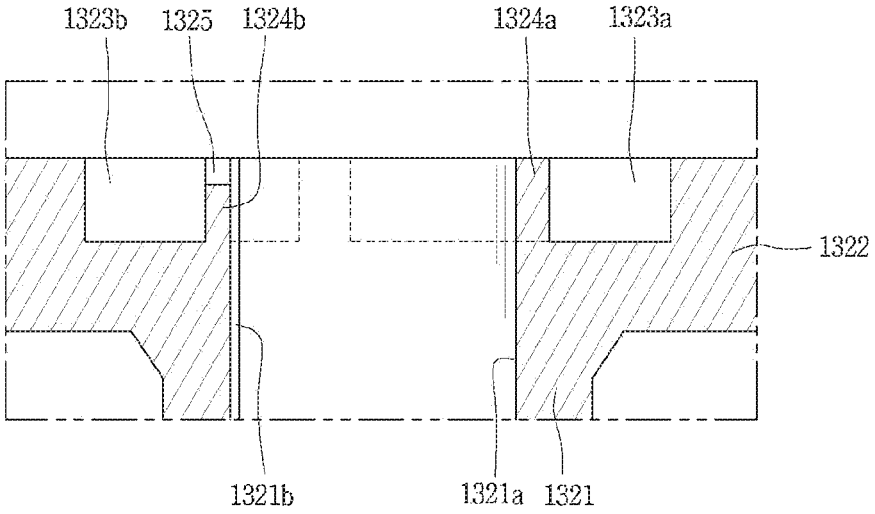
FIG. 11 is a sectional view taken along line "VII-VII" of FIG. 10.
Figure 12:
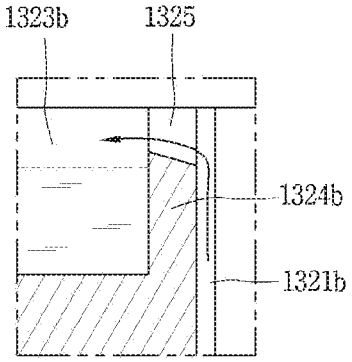
FIG. 12 is a sectional view illustrating another embodiment of a communication flow path of FIG. 11 according to the present disclosure.

FIG. 10 is an enlarged perspective view illustrating another embodiment of a part "A" of FIG. 6 according to the present disclosure, FIG. 11 is a sectional view taken along line "VII-VII" of FIG. 10, and FIG. 12 is a sectional view illustrating another embodiment of a communication flow path of FIG. 11 according to the present disclosure.

Referring to FIGS. 10 and 11, the second communication path 1325 may be formed as a communication groove having a predetermined depth and a circumferential length on an end surface of the second bearing protrusion portion 1324*b*. In the second communication flow path 1325 formed as the communication groove according to this embodiment, a height of a portion where the second communication flow path 1325 is formed is lower than that of the first bearing protrusion portion 1324*a*.

The second communication flow path 1325, as described above, is formed so as to overlap the second oil groove 1321*b*. As illustrated in FIG. 11, the second communication flow path 1325 may be formed to have the same cross-sectional area, namely, to be parallel at the inner circumferential surface side of the first bearing protrusion portion 1324*b*, which is an inlet of the second communication flow path 1325, and at the outer circumferential surface side of the first bearing protrusion portion 1324*b*, which is an outlet of the second communication flow path 1325.

However, as shown in FIG. 12, the second communication flow path 1325 may alternatively be formed in an inclined manner. For example, similar to the case of being formed as the communication hole, the second communication flow path 1325 may be formed to have different cross-sectional areas at the inner circumferential surface side of the second bearing protrusion portion 1324*b*, which is the inlet, at the outer circumferential surface side of the second bearing protrusion portion 1324*b*, which is the outlet.

As a result, oil can be quickly and smoothly introduced into the second pocket 1323*b* to be effectively stored in the second pocket 1323*b*. In this way, oil can be supplied to the back pressure chamber communicating with the second pocket 1323*b* without interruption.

Meanwhile, the first and second bearing protrusion portions can provide a sort of elastic bearing effect by the first pocket and the second pocket. Since the first and second bearing protrusion portions form a ring-shaped strip along the circumferential direction, substantially a discontinuous bearing surface is formed. Accordingly, a high elastic bearing effect can be expected.

To enhance the elastic bearing effect, preferably, a width of the first and the second bearing protrusion portions is as thin and deep as possible while ensuring a minimum sealing distance between the first and the second bearing protrusion portions.

Figure 13:
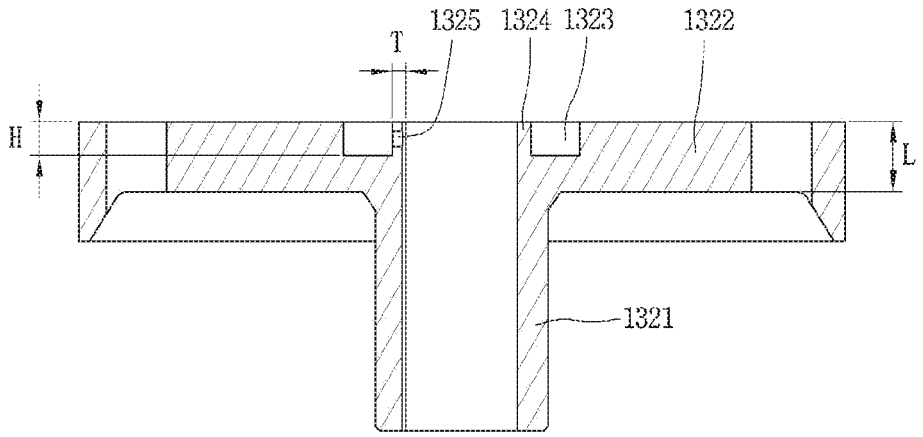
FIG. 13 is a horizontal sectional view of a sub bearing for explaining dimensions of a back pressure pocket and a bearing protrusion portion according to the present disclosure.
Figure 14:
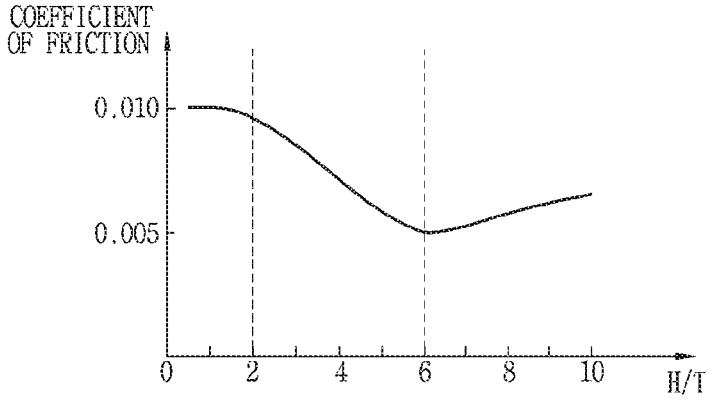
FIG. 14 is a graph illustrating comparison results of a coefficient of friction according to an elastic bearing ratio in accordance with an embodiment of the present disclosure.

FIG. 13 is a horizontal sectional view of a sub bearing for explaining dimensions of a back pressure pocket and a bearing protrusion portion according to the present disclosure, and FIG. 14 is a graph illustrating comparison results of a coefficient of friction according to an elastic bearing ratio in accordance with an embodiment of the present disclosure.

Here, the first pocket and the second pocket may be made different in size, but description will be given under assumption of having the same size for convenience of explanation. This will be equally applied to the first bearing protrusion portion and the second bearing protrusion portion.

Referring to FIG. 13, if an axial depth of the back pressure pocket 1323 is H and a radial width of the bearing protrusion 1324 is T, an elastic bearing ratio (H/T), which is obtained by dividing the axial depth of the back pressure pocket by the radial width of the bearing protrusion, may be decided to satisfy $2 \leq H/T \leq 6$. It can be seen from comparison results of correlation between an elastic bearing ratio and a coefficient of friction.

Referring to FIG. 14, the elastic bearing ratio (H/T) decreases slowly from 0 to 2, but drops sharply from 2 to 6. This is because the axial depth of the bearing protrusion portion 1324 is formed to be too short (low) compared to its radial width so that the axial depth H of the bearing protrusion portion 1324 is much shorter than its width (thickness) T, resulting in insufficient elastic force.

The elastic bearing ratio rises slowly from 6 to 10 as illustrated in the graph. This is because the axial depth H of the bearing protrusion portion 1324 is formed to be too long (deep) comparted to its radial width so that the depth (length) of the bearing protrusion 1324 is much longer than its width, resulting in insufficient elastic force. Therefore, the elastic bearing ratio according to the embodiment of the present disclosure is preferably set to satisfy $2 \leq H/T \leq 6$.

Table 1 below shows the comparison results of a case of employing the elastic bearing and a case without employing the elastic bearing on a critical load, a coefficient of friction, discharge pressure, and a pressure ratio. The case without employing the elastic bearing means a case without employing a back pressure pocket.

TABLE 1

| Item | The related art | The present disclosure |
|---|---|---|
| Critical load (N) | 2900 | 6200 |
| Coefficient of friction | 0.009 | 0.005 |
| Discharge pressure (kgf/cm$^2$) | 42 | 46 |
| Pressure ratio | 7.5 | 8.5 |

As can be seen in Table 1, a critical load on a bearing is improved by about 114%, a coefficient of friction is reduced by about 49%, discharge pressure is increased by about 46%, and a pressure ratio is increased by about 13% in the present disclosure employing an elastic bearing, compared to the related art without employing an elastic bearing.

From the results above, it can be seen that employment of the back pressure pocket according to the present disclosure improves all the critical load, friction coefficient, discharge pressure, and pressure ratio. In particular, considering the increase in discharge pressure, is the present disclosure may be suitable for an eco-friendly high-pressure refrigerant such as R32, R410a, and CO2, which has low ozone depletion potential (ODP) and global warming index (GWP).

Referring back to FIG. 13, rigidity of the flange portion needs to be considered when designing the back pressure pockets and the bearing protrusion portions to have the appropriate elastic bearing ratio as described above. In more detail, in the vane rotary compressor according to the embodiment of the present disclosure, the sub bearing as well as the main bearing are coupled to the cylinder through bolts. Generally, coupling force required for coupling five bolts is about 80 to 110 kgf/cm$^2$. Therefore, rigidity of the flange portion which is high enough to withstand such coupling force needs to be secured for maintaining reliability.

For this purpose, when a depth of the back pressure pocket is H and a thickness of the flange portion is L, it is preferable to satisfy $H-L \geq 2$. For example, if the thickness of the flange portion is 10 to 12 mm, then an axial depth of the back pressure pocket can be approximately 8 to 10 mm. Therefore, the minimum thickness of the flange portion needs to be at least 2 mm or larger to maintain reliability when applying the coupling force described above.

Meanwhile, the aforementioned embodiments exemplarily illustrate a single-cylinder type vane rotary compressor, but in some cases, the elastic bearing structure employing the back pressure pockets may also be applicable to a twin-cylinder type vane rotary compressor in which a plurality of cylinders are arranged in an axial direction. In this case, however, an intermediate plate may be provided between the plurality of cylinders, and the back pressure pockets may be formed on both axial side surfaces of the intermediate plate, respectively.

What is claimed is:

1. A vane rotary compressor, comprising:

a cylinder;

a main bearing and a sub bearing coupled to the cylinder, the main bearing and the sub bearing forming a compression space together with the cylinder, the main bearing including a main bearing back pressure pocket and the sub bearing including a sub bearing back pressure pocket;

a rotation shaft radially supported by the main bearing and the sub bearing;

a roller including a plurality of vane slots spaced apart from each other along a circumferential direction, each vane slot including one end open toward an outer circumferential surface of the roller, and a back pressure chamber disposed adjacent an opposite end of the vane slot, the back pressure chamber being configured to communicate with at least one of the main bearing back pressure pocket or the sub bearing back pressure pocket; and a plurality of vanes slidably inserted into the vane slots, the vanes being configured to protrude in a direction toward an inner circumferential surface of the cylinder, the vanes being arranged so as to divide the compression space into a plurality of compression chambers, wherein the at least one of the main bearing back pressure pocket or the sub bearing back pressure pocket includes a plurality of pockets having different inner pressure along the circumferential direction, wherein the plurality of pockets include bearing protrusion portions formed on an inner circumferential side, the protrusion portions forming radial bearing surfaces with respect to an outer circumferential surface of the rotation shaft, and wherein $2 \leq H/T \leq 6$ when an axial depth of the at least one of the main bearing back pressure pocket or the sub bearing back pressure pocket is H and a radial width of the bearing protrusion portion is T.

2. The compressor of claim 1, wherein the plurality of pockets include:

a first pocket having a first pressure; and a second pocket having a second pressure higher than the first pressure, wherein a bearing protrusion portion of the second pocket includes a communication flow path through which an inner circumferential surface of the bearing protrusion portion communicates with an outer circumferential surface of the bearing protrusion portion.

3. The compressor of claim 2, wherein at least a part of the communication flow path overlaps an oil groove provided on a radial bearing surface of the main bearing or the sub bearing.

4. The compressor of claim 3, wherein the communication flow path is formed as a communication groove recessed by a predetermined width and depth into an axial end surface of the bearing protrusion portion.

5. The compressor of claim 3, wherein the communication flow path is formed as a communication hole penetrating through the inner circumferential surface and the outer circumferential surface of the bearing protrusion portion.

6. The compressor of claim 3, wherein the communication flow path is formed so that an area thereof at an inner circumferential surface of the bearing protrusion portion is larger than an area at an outlet side thereof.

7. The compressor of claim 1, wherein $L-H \geq 2$ mm when a portion defining a compression space on the main bearing or the sub bearing is referred to as a flange portion and a thickness of the flange portion is L.

8. The compressor of claim 7, wherein the bearing protrusion portion is formed to have a same axial depth and a radial width along the circumferential direction.

9. The compressor of claim 1, wherein the roller is concentric with a center of the rotation shaft and eccentric with respect to a center of the cylinder.

10. The compressor of claim 9, wherein the roller has an outer circumferential surface positioned closer to the inner circumferential surface of the cylinder at one circumferential location relative to other circumferential locations.

11. The compressor of claim 1, wherein the rotation shaft includes an oil flow path formed in a central portion thereof along an axial direction, wherein the oil flow path includes an oil passage hole extending from an inner circumferential surface thereof toward the outer circumferential surface of the rotation shaft, and wherein the oil passage hole is positioned between ends of within the radial bearing surface.

12. The compressor of claim 11, wherein the oil passage hole is formed in a manner that at least part thereof overlaps an axial range of the bearing protrusion portion.

13. A vane rotary compressor, comprising:

a casing;

a motor located in the casing;

a cylinder located in the casing;

a main bearing positioned between the motor and the cylinder on one side of the cylinder;

a sub bearing positioned opposite to the main bearing on an opposite side of the cylinder, the main bearing and the sub bearing being coupled to the cylinder and defining a compression space between the main bearing and the sub bearing, at least one of the main bearing or the sub bearing including a back pressure pocket disposed adjacent an inner circumferential surface of a respective one of the main bearing or the sub bearing;

a roller positioned in the compression space, the roller including a plurality of circumferentially spaced apart vane slots extending into the roller from open ends on an outer circumferential surface of the roller to closed ends within the roller;

a plurality of vanes slidably positioned in the vane slots, the vanes being separated from the closed ends of the vane slots by back pressure chambers, the vanes protruding from the open ends toward an inner circumferential surface of the cylinder;

a rotation shaft having a first end coupled to the motor and a second end coupled to the roller, the rotation shaft extending through both the main bearing and the sub bearing;

wherein at least one back pressure chamber of at least one of the vane slots is configured to communicate with at least one of the main bearing back pressure pocket or the sub bearing back pressure pocket, and wherein $2 \leq H/T \leq 6$ when an axial depth of the at least one of the main bearing back pressure pocket or the sub bearing back pressure pocket is H and a radial width of the bearing protrusion portion is T.

14. The compressor of claim 13, wherein the main bearing includes an inner opening configured to receive the rotation shaft, and the main bearing back pressure pocket is separated from the inner opening by an axially extending bearing protrusion portion.

15. The compressor of claim 14, further including a generally cylindrical oil flow passage extending axially within the rotation shaft.

16. The compressor of claim 15, further including a flow passage fluidly coupling the main bearing back pressure pocket with the oil flow passage within the rotation shaft.

17. The compressor of claim 15, wherein the flow passage includes a radial slot in the bearing protrusion portion, the radial slot extending between the main bearing back pressure pocket and the oil flow passage within the rotation shaft.

18. The compressor of claim 13, wherein $L-H \geq 2$ mm when a portion defining a compression space on the main bearing or the sub bearing is referred to as a flange portion and a thickness of the flange portion is L.

19. The compressor of claim 18, wherein the bearing protrusion portion is formed to have a same axial depth and a radial width along the circumferential direction.

20. A vane rotary compressor, comprising:

a cylinder;

a main bearing and a sub bearing coupled to the cylinder, the main bearing and the sub bearing forming a compression space together with the cylinder, the main bearing including a main bearing back pressure pocket and the sub bearing including a sub bearing back pressure pocket;

a rotation shaft radially supported by the main bearing and the sub bearing;

a roller including a plurality of vane slots spaced apart from each other along a circumferential direction, each vane slot including one end open toward an outer circumferential surface of the roller, and a back pressure chamber disposed adjacent an opposite end of the vane slot, the back pressure chamber being configured to communicate with at least one of the main bearing back pressure pocket or the sub bearing back pressure pocket; and a plurality of vanes slidably inserted into the vane slots, the vanes being configured to protrude in a direction toward an inner circumferential surface of the cylinder, the vanes being arranged so as to divide the compression space into a plurality of compression chambers, wherein the at least one of the main bearing back pressure pocket or the sub bearing back pressure pocket includes a plurality of pockets having different inner pressure along the circumferential direction, wherein the plurality of pockets include bearing protrusion portions formed on an inner circumferential side, the bearing protrusion portions forming radial bearing surfaces with respect to an outer circumferential surface of the rotation shaft, wherein the plurality of pockets include:

a first pocket having a first pressure; and a second pocket having a second pressure higher than the first pressure, wherein a bearing protrusion portion of the second pocket includes a communication flow path through which an inner circumferential surface of the bearing protrusion portion communicates with an outer circumferential surface of the bearing protrusion portion, and wherein the bearing protrusion portions form an annular shape to substantially close an inner circumferential side of the plurality of pockets facing the rotation shaft, and wherein $2 \leq H/T \leq 6$ when an axial depth of the at least one of the main bearing back pressure pocket or the sub bearing back pressure pocket is H and a radial width of the bearing protrusion portion is T.

21. The compressor of claim 20, wherein $L-H \geq 2$ mm when a portion defining a compression space on the main bearing or the sub bearing is referred to as a flange portion and a thickness of the flange portion is L.

* * * * *